United States Patent [19]

Bisson

[11] Patent Number: 4,765,268

[45] Date of Patent: Aug. 23, 1988

[54] AUTOMATIC DEVICE FOR DETACHING THE CAM FOLLOWERS IN A SEWING MACHINE

[75] Inventor: Flavio Bisson, Cava Manara, Italy

[73] Assignee: Necchi Societa per Azioni, Pavia, Italy

[21] Appl. No.: 3,818

[22] Filed: Jan. 16, 1987

[30] Foreign Application Priority Data

Mar. 12, 1986 [IT] Italy ..... 42906 A/86

[51] Int. Cl.[4] ..... D05B 3/02

[52] U.S. Cl. ..... 112/465

[58] Field of Search ..... 74/568 R; 112/448, 463, 112/465

[56] References Cited

U.S. PATENT DOCUMENTS

| | | | |
|---|---|---|---|
| 3,356,052 | 12/1967 | Bono | 112/465 |
| 3,435,788 | 4/1969 | Fresard et al. | 112/465 X |
| 3,792,673 | 2/1974 | Bianchi | 112/463 |

*Primary Examiner*—W. Carter Reynolds

*Attorney, Agent, or Firm*—Stevens, Davis, Miller & Mosher

[57] ABSTRACT

Automatic device for detaching the cam followers in a sewing machine where a selector knob, when it is rotated, provides the detachment of the cam followers in the first portion of rotation, and positions the desired cam in correspondence of the cam follower in the second portion of rotation. On the reduction collar of the selector knob two opposite grooves are made out, which engage pins transmitting the translation movement to a shaft which operates a cam follower detaching lever.

4 Claims, 2 Drawing Sheets

FIG. 1
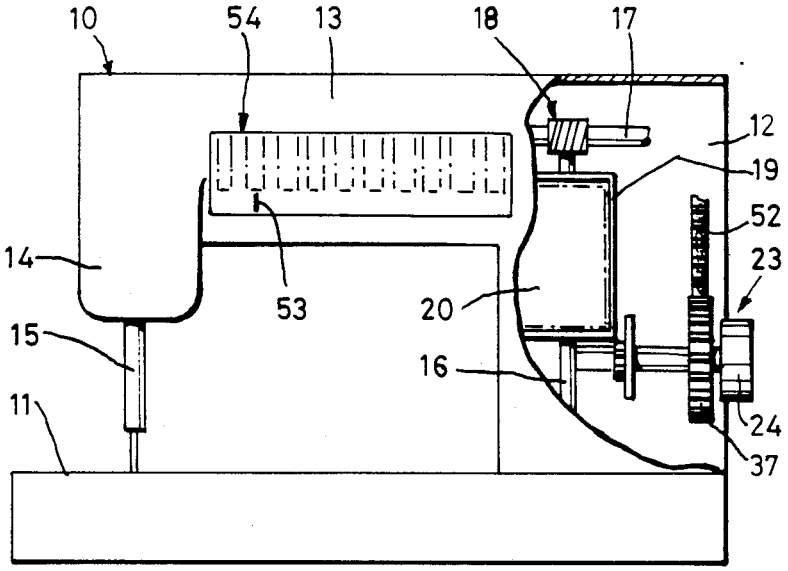
FIG. 4
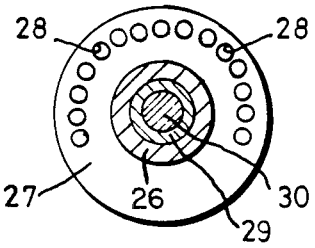
FIG. 5
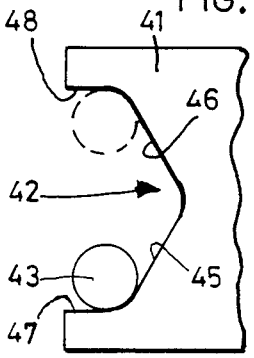
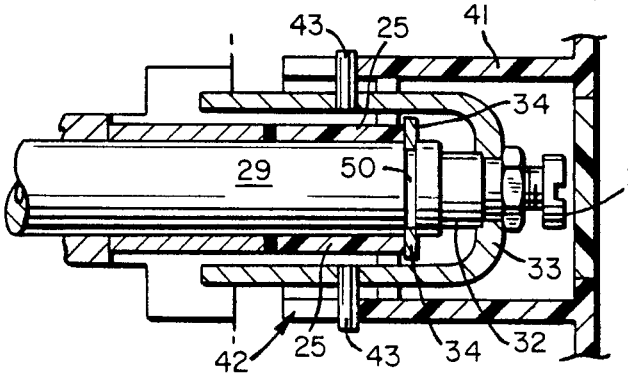
FIG. 6

AUTOMATIC DEVICE FOR DETACHING THE CAM FOLLOWERS IN A SEWING MACHINE

The present invention relates to an automatic device for detaching the cam followers in a sewing machine in which the needle bar is made to oscillate transversely of the direction in which the fabric moves in order to sew a pattern rather than a straight line. Sewing machines for the execution of ornamental sewings are known where the operator, every time he chooses a new pattern, must utilize a lever for detaching the cam followers from the previously coupled cams and displace the cam pile or the cam follower so as to obtain the cam follower-cam coupling according to the new selected pattern. Should the operator fail to detach the cam followers and try to displace the cam pile, persistence in this wrong maneuver with a certain force, will cause the cam followers to be damaged if made out of thin sheet metal or the outline of the cams may be spoiled if made out of plastic material.

In other sewing machines, for executing ornamental sewings, the cams are spaced in such a way that, during their axial displacement, they contact inclined walls of the cam followers, causing the radial displacement of the cam followers in order to permit the cam followers to overcome the differences in height existing between the outline in contact and the selected one of the new cam. In this type of machine the number of the obtained patterns is limited because of consistent distance between two contiguous cams. In this way a pile with a few cams results in the machine. It is the object of the present invention to overcome the above-described drawbacks.

The technical problem to be solved was that of realizing an automatic device for detaching the cam followers from the cams where the operator, with a sole maneuver may detach the cam follower and displace the cam pile so that the pile may contain a great number of cams and as a consequence a great number of patterns may be obtained. The solution of the technical problem is accomplished by a selector knob, when rotated, providing the displacement of the support of the cam pile, in the first portion of rotation occurring the detachment of the cam follower and in the second portion of rotation the positioning of the pile relatively to the cam follower, first means being provided for detaching the cam follower and second means for releasing positioning and locking the cam pile in correspondence to the cam follower.

BRIEF DESCRIPTION OF THE DRAWINGS

Further characteristics and advantages will become more readily apparent from the following description and from the enclosed drawings in which:

FIG. 1 is a front elevational view of the sewing machine to which the device of the present invention is applied;

FIG. 4 shows a detail of the device of FIG. 2;

FIG. 5 is a detail of FIG. 3; and

FIG. 6 is an enlarged portion of FIG. 2 showing the knob mounting.

DETAILED DESCRIPTION OF THE INVENTION

Figure 2:
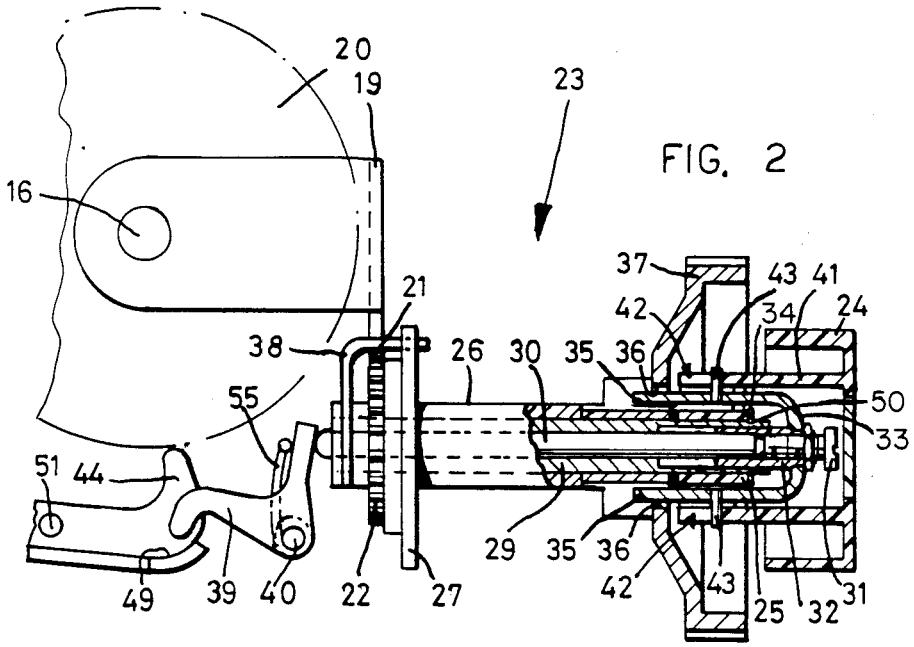
FIG. 2 is a plan view showing in detail the device of FIG. 1 in its inoperative position.

With reference to FIG. 1, generally indicated is a sewing machine 10 formed by a bed 11, a standard 12 rising from bed 11, a bracket arm 13 and a head 14 placed at an end of arm 13 from which the needle bar 15 extends.

A vertical shaft 16 is coupled to the main shaft 17 of the sewing machine and rotated by shaft 17 via a couple of gears 18. A bridge support 19 is freely mounted on the shaft 16 and a cam pile 20 is also mounted on shaft 16 within support 19, free to follow support 19 in its movements along the axis of shaft 16, but fixedly connected to the same shaft in the rotation around its own axis. The connection of vertical shaft 16, bridge support 19 and cam pile 20 is not described in detail as it is known in the art.

The bridge support 19, provides for positioning the pile 20 and has a rack 21 constantly engaged with a gear 22 fixed on a hollow shaft 26 enclosed in the automatic device 23 which is an object of the present invention.

Figure 3:
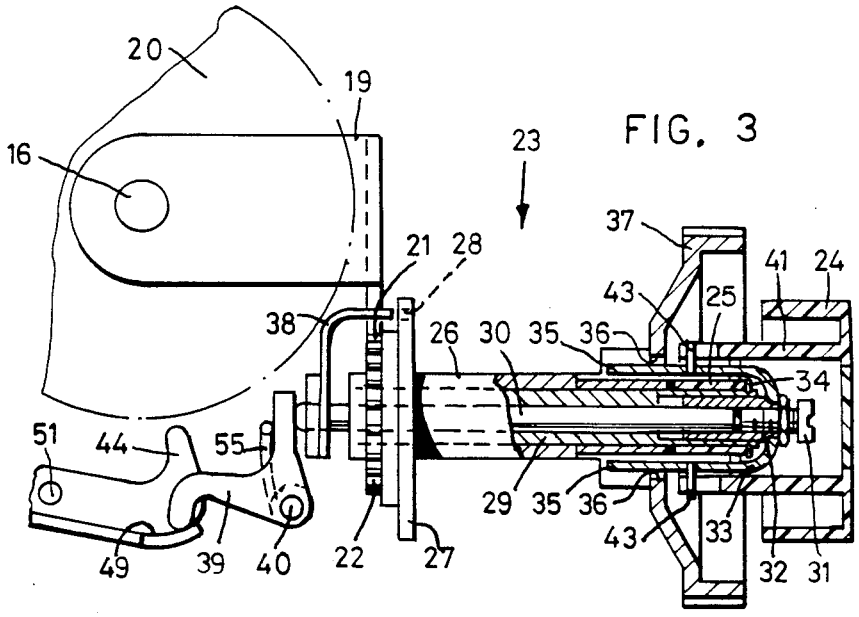
FIG. 3 is a plan view showing in detail the device of FIG. 1 in its operative position.

Device 23 (FIGS. 2 and 3) is composed by a selector knob 24 which extends from the standard 12 and is handled by the operator for selecting the cam corresponding to the desired pattern. This knob 24 has a reduction collar 41 on which are formed two radially opposed grooves, each groove is formed by two inclined planes 45 and 46 forming a laid down V and by two planes 47 and 48 parallel to the axis of the selector knob 24 (FIG. 5).

Grooves 42 are engaged by pins 43 fixed to a laid down U-shaped element 33, fixed in turn to a first bush 32. The free ends 35 of the laid down U-shaped element 33 may run in seats 36 formed in a toothed pulley 37 when the selector knob 24 is rotated. The pulley 37 is solidal to the hollow shaft 26 carrying the gear 22. In proximity of gear 22, on the shaft 26 there is fixed a disk 27, on which holes 28 are formed circumferentially and spaced equidistantly (FIG. 4), the function of which will be explained hereinafter.

A second bush 29 is placed inside the hollow shaft 26, the toothed pulley 37 and the hub 25 of the selector knob 24. The hub 25 is held on the second bush 29 by a split ring washer 34 fitting into a groove 50 on bush 29. Inside the second bush 29 is a shaft 30, an end of which is in contact with the ends of a screw 31, partially screwed on the first bush 32, which may run in the second bush 29, as it will be explained hereinafter. The axial regulation of the screw 31 determines the position of the other end of the shaft 30 which extends from the second bush 29.

To the other end of the shaft 30 a bolt element 38 is keyed, and axially displaceable with shaft 30, which engages the holes 28 of the disk 27 for locking the shaft 26 and consequently the knob 24 in a predetermined position.

The end of the shaft 30 which comes out from the bush 29 engages a cam follower detaching lever 39 pivoted and free to oscillate at 40.

When the operator desires to select a predetermined pattern, the operator utilizes the selector knob 24 causing it to rotate clockwise or counterclockwise in order to displace the cam pile vertically until the cam for executing the selected pattern is positioned in correspondence with cam follower 44 which transmits in a known way the transversal oscillations to the needle bar 15. In the first portion of the rotation of the knob 24 the pins 43 (FIG. 5) are pushed, in case of clockwise rotation, along the inclined plane 45 of the groove 42 until they assume the position illustrated in FIG. 5. In FIG. 5 there is illustrated in dotted line the position in which the pins 43 would find themselves by the rotation of the knob 24 counterclockwise. The movement of the pins 43 causes a translation along the axis of the shaft 30 of the U-shaped element 33 and of the first bush 32 which slides in the second bush 29.

As the screw 31 is solidal to the first bush 32, also screw 31 translates and pushes the shaft 30 axially so that the bolt element 38 disengages from the holes 28 of the disk 27 and the end of shaft 30 causes the cam followers detaching lever 39 to rotate around the pin 40. By this rotation the lever 39 comes in contact with a lug 49 of the cam follower 44 and causes cam follower 44 to detach from the cam pile 20 rotating it around the pivot 51.

Continuing with the rotation of the knob 24, the plane 47 of the groove 42 comes in contact with the pins 43. This coupling causes the rotation of the laid down U-shaped element 33 around the axis of the shaft 30. This rotation, via the free ends 35 of element 33, the toothed pulley 37 and the hollow shaft 26, is transmitted to the gear 22 which is coupled to the rack 21 of the bridge support 19. The rotation of the gear 22 causes an axial displacement of bridge element 19 and as a consequence of the cam pile 20 until the desired cam is brought into correspondence with cam follower 44.

The toothed pulley 37, via a belt 52, displaces in a known way an indicator 53 (FIG. 1) which runs along a plate 54 in order to indicate which cam, corresponding to the pattern of plate 54, is in correspondence with the cam follower 44.

When the indicator 53 is positioned on the desired pattern, the operator releases the selector knob 24. By this maneuver, the cam follower detaching lever 39, under the action of a recall spring 55, returns to its position illustrated in FIG. 2. This causes an axial displacement of the shaft 30 and as a consequence the pins 43 run along the inclined plane 45 until they reach the inoperative position and the bolt element 38 engages one of the holes 28 of the disk 27 so as to lock the cam pile 20 in the desired position. The return of the cam follower detaching lever 39 frees the cam follower 44 which engages the cam corresponding to the desired pattern.

I claim:

1. Automatic device for detaching the cam followers in a sewing machine comprising a shaft coupled to the main shaft of the machine, a support freely mounted on said shaft, a cam pile mounted on said shaft within said support, free to follow said support in its movements along the axis of said shaft, but fixedly connected to the same shaft in the rotation around its own axis, a selector knob mounted on said machine rotatable through first and second arcs of rotation, in said first arc of rotation occurring the detachment of the cam follower and in the second arc of rotation the positioning of said cam pile relatively to same cam follower, first means in contact with said knob for detaching said cam follower and second means attached to said knob for releasing, positioning and locking said cam pile in correspondence with said cam follower.

2. The device according to claim 1, wherein said first means comprise a laid down U-shaped element having free ends and pins extending therefrom in contact with said knob, first and second bushing, said first bushing fixed to said element, a shaft within said first and second bushings, a screw partially screwed to said first bushing and having an end in contact with an end of said shaft which runs axially in said second bushing, a cam follower detaching lever, the other end of said shaft being in contact with said cam follower detaching lever, said cam follower detaching lever pivotable and free to oscillate around a pin, said lever being contactable with a lug of a cam follower, said second means being provided on said knob for displacing said element along the axis of said shaft in order to pivot said lever and detach the cam follower, a recall spring on said lever adapted to bias said lever to a release position and as a consequence said knob in the inoperative position when this knob is released.

3. The device according to claim 2, wherein said second means on said knob are radially opposite grooves, made out on a reduction collar of said knob, each of said grooves being formed by two inclined planes to form a laid down V along which said pins run during the first portion of the rotation of said knob.

4. The device according to claim 2, wherein said second means comprise a hollow shaft, a disk defining holes therein fixed to said hollow shaft, a bolt element engageable with said holes in said disk, gear mounted on said hollow shaft, and rack or said support, said gear engaging with said rack, said bolt element being placed at the end of said shaft in contact with said cam follower detaching lever for displacing axially with said shaft during the first arc of rotation of said knob for disengaging from said disk and for locking said disk when said knob is released, a toothed pulley, said hollow shaft being solidal with said toothed pulley, engaged by the free ends of said laid down U-shaped element, for rotating during the second arc of rotation of said knob and displacing said cam pile.

* * * * *